US005449856A

United States Patent [19]

Nakamori

[11] Patent Number: 5,449,856

[45] Date of Patent: Sep. 12, 1995

[54] MUSIC BOX

[75] Inventor: Takanori Nakamori, Tokyo, Japan

[73] Assignee: Rockapetta Industrial Co., Ltd., Hong Kong

[21] Appl. No.: 241,575

[22] Filed: May 12, 1994

[51] Int. Cl.[6] ..... G10F 1/06

[52] U.S. Cl. ..... 84/95.1

[58] Field of Search ..... 84/95.1, 95.2, 94.1, 84/94.2

[56] References Cited

U.S. PATENT DOCUMENTS 4,197,778 4/1980 Komatsu et al. ..... 84/95.1

4,458,573 7/1984 Isaka ..... 84/95.1

*Primary Examiner*—M. L. Gellner

*Assistant Examiner*—Patrick J. Stanzione

*Attorney, Agent, or Firm*—Samuels, Gauthier & Stevens

[57] ABSTRACT

A music box having a base, a spring box, a sound mechanism, a speed regulator and a gear transmission system. The spring box contains a driving gear and a spring leaf for winding up. The sound mechanism contains a metal comb and a cylinder. Sounds are produced when the teeth on the comb are plucked by pins protruding from the cylinder. The gear transmission system transfers the spring recoil through the driving gear to the cylinder and the speed regulator. The music box also contains a support for locating the speed regulator and the gear mechanism. The support and the base are firmly assembled. Also, the speed regulator includes a constant speed mechanism.

7 Claims, 3 Drawing Sheets

MUSIC BOX

1. FIELD OF THE INVENTION

This invention relates to a new model of music box.

2. BACKGROUND OF THE INVENTION

Currently, spring type music boxes are very common and applications are wide spread. However, existing music boxes have the following disadvantages:

1. A music box can breakdown easily as the fragile parts are prone to damage during transportation and installation. In particular, a slight push at the speed regulator can dislocate its axis of rotation, which will cause the speed regulator to rotate unproperly and may even stall the rotation.

2. When the music box is in motion, the rhythm is irregular due to the variations in the spring tension, and the music becomes unpleasant.

3. In most of the music boxes, the gears in the transmission systems are usually made of metal. To avoid rusting, the gears are electroplated or coated with anti-rust paint. This can achieve the anti-rust effect temporarily, but gears still rust after long period of use and movements of the music box will become unsmooth.

SUMMARY OF THE INVENTION

The purpose of the present invention is to propose a modified model of music box.

The aim of this new design is to provide a music box with the following parts:

a base;

a spring box comprises a spring leaf for winding and a driving gear. There is a location hole on one side of the spring box;

a sound mechanism including a metal comb and a cylinder. One end of the cylinder is supported in the location hole of the spring box and the other end is mounted on a supporting element. Teeth on the comb are plucked by pins protruding from the rotating cylinder;

a speed regulator which also contains a constant speed mechanism;

a gear transmission system which transmits the spring recoil through the driving gear to the cylinder and the speed regulator;

the music box also includes a support for locating the speed regulator and the gear transmission. This support is located firmly to the base.

In this new design, the constant speed mechanism contains a constant speed device which is made of soft silicon. When the constant speed device rotates, the centrifugal force will cause the two wings to expand to touch the sides of the constant speed disc to generate friction.

According to this new design, the transmission gears and supports are made of the best kind of engineering plastics.

According to this new design, there is a resonance slot on the bottom of the base of the music box.

DESCRIPTION OF THE PREFERRED EMBODIMENT

In this new model of music box, a support used for mounting the speed regulator is installed to the base. The support is made of engineering plastic and is firmly fixed to the base at 3 points. As the installation is firm enough, the speed regulator is prevented from dislocating its axis of rotation in a collision, and hence avoiding this kind of breakdown problem. The speed regulator is equipped with a constant speed mechanism. When the speed regulator rotates, the constant speed mechanism can control and maintain a constant revolving speed. Therefore, the revolving speed of the sound generation cylinder is also constant, the system can then maintain a regular rhythm irrespect of the variations in the spring tension. The transmission gears are also made of engineering plastics so that they do not rust and hence the movements will not be affected.

Figure 1:
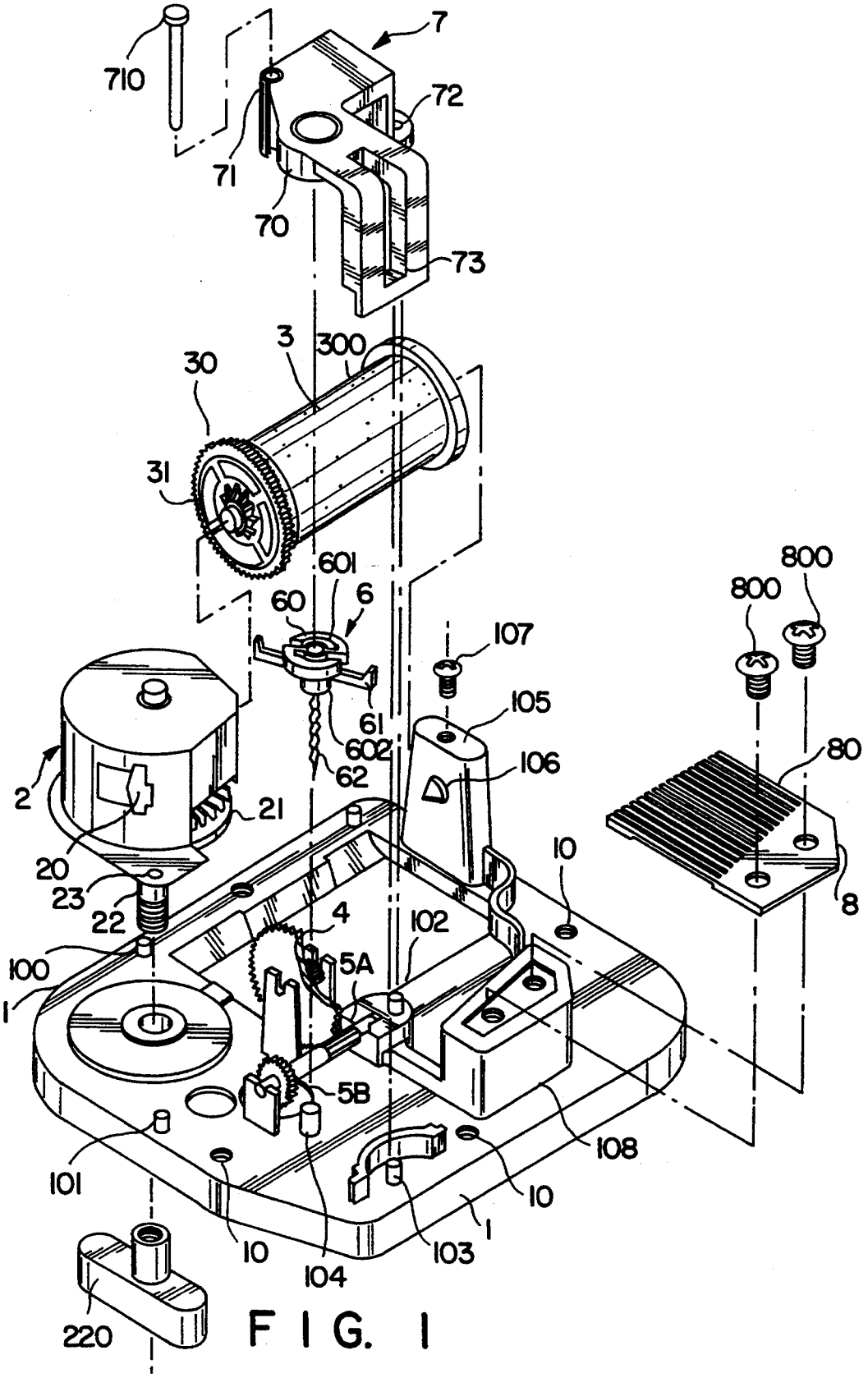
FIG. 1 is an exploded view of the music box in accordance with the present invention.
Figure 2:
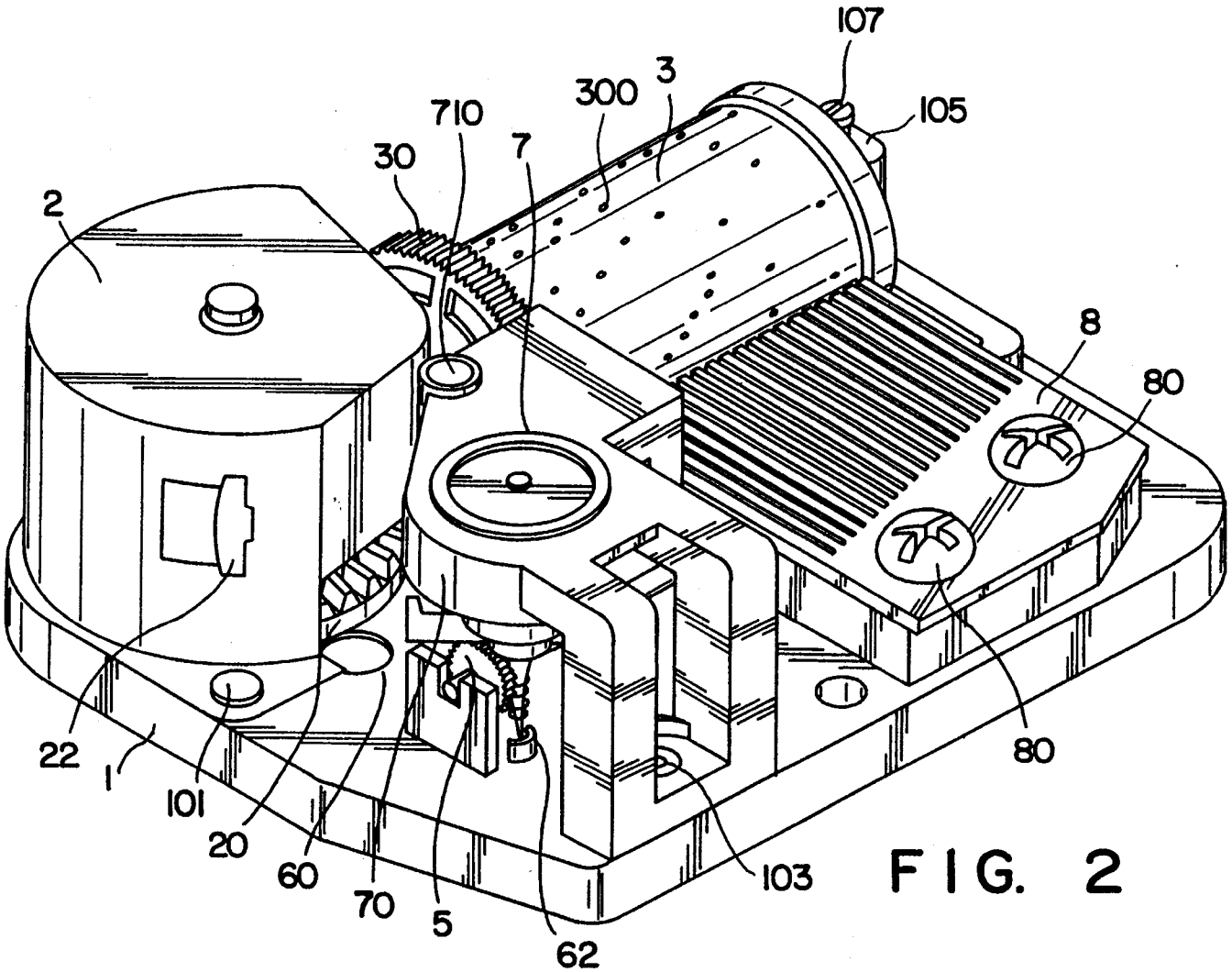
FIG. 2 is an isometric view of the assembled music box.
Figure 3:
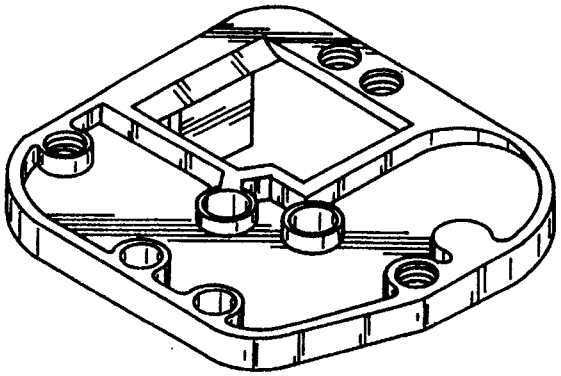
FIG. 3 is an isometric view of the base.

As dipicted in FIGS. 1 and 2, the music box consists of a base [1] with a number of threaded holes [10] and dowel pins [101], [102], [103], [104] for fabricating the accessory parts. Dowel pin [104] is used to locate the speed regulator [6]. Supports [105], [106], and [107] are used for mounting one end of the cylinder [3]. The platform [108] is used to fasten the metal comb [8]. There is a resonance slot on the base [1] of the music box (FIG. 3). The spring box [2] consists of a spring leaf [20], a driving gear [21] and a axle [22] for winding the spring leaf. The lower end of the axle passes through a hole in the base [1] and connects to the key [220]. On the bottom of the spring leaf [2], small holes [23] are fitted to the dowel pins [100] and [101]. On the side face of the spring box [2], a hole is used to locate one end of the cylinder axle [3]. The other end of the cylinder axle [3] is mounted on the apex of the conical stock. One end of the axle [3] is installed with driving gears [30] and [31]. Gear [31] meshes with gear [21] in the spring box [2]. Therefore, gear [31], gear [30], gear train [4], gear train [5A], and gear train [5B] form a gear transmission system. Gears in this gear transmission system are made of engineering plastics to avoid rusting. A speed regulator [6], comprises a rotation stopper [61] and a screw shaft [62] which meshes with the transmission gear [5B]. The regulator also contains a constant speed device which is made of soft silicon. When the constant speed device rotates, the centrifugal force will cause the two wings [601] and [602] to expand. The upper and lower ends of the regulator [6] are located to the dowel pin [104] and the support [7] respectively. The speed regulator can start to rotate rapidly when power is transmitted from the gear transmission system. Support [7] is used to locate the speed regulator [6], to increase the stability and to keep the regulator axle in alignment after collision. It also fastens the gear transmission system to prevent the gears from loosening. Holes [72] and [73] on the support [7] are used for assembling the dowel pins [102] and [103]. There is another hole [71] in the support [7]. An insertion pin [710] is inserted through this hole [71] and then fitted into a small hole (not shown in the figure) in the base to assemble. The support and the base are firmly fabricated at the locations [71], [72] and [73]. On the upper part of the support [7], there is a constant speed device disc [70] which, together with the constant speed device element [60], constitutes the constant speed mechanism. Support [7] is also made of engineering plastic. A metal comb [8] is fastened to the platform [108] by two screws [800]. The vibrating teeth [80] are plucked by pins [300] protruding from the sound cylinder to generate the sounds. That is, cylinder [3] and the comb [8] grouped to form the sound mechanism. While producing the music, gear trains [4], [5], [30] and [31] are in motion, and the cylinder [3] and the speed regulator rotates consequently. The speed of the cylinder [3] influence the speed of the music, and the speed of the cylinder [3] is controlled by the speed regulator [6]. If the spring tension is not high enough, regulator [6] will stop and music will stop subsequently.

Figure 4A:
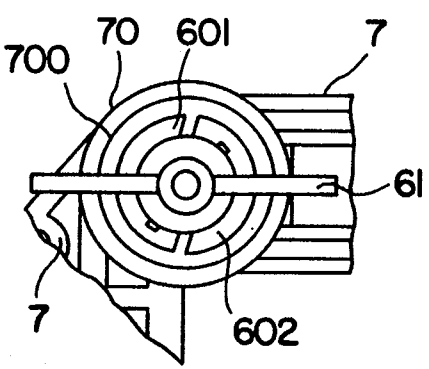
FIGS. 4*a*, 4*b* and 4*c* are views of the speed regulator and the constant speed mechanism.
Figure 4C:
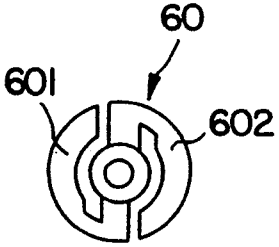
Figure 4B:
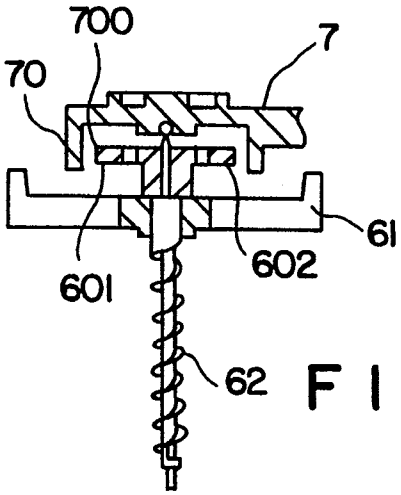

FIGS. 4*a*, 4*b* and 4*c* show the construction of the constant speed mechanism. Constant speed device element [60] is made of silicon. There are two wings [601] [602] in this element (FIG. 4*c*). When the constant speed device rotates, the centrifugal force will cause the two wings to expand to touch the sides of the constant speed disc, the corresponding frictional force will cause the constant speed device to maintain a constant revolving speed. If the spring recoil is not large enough to overcome the friction within the gear transmission system, all motions will stop. Therefore, the speed regulator can always maintain a constant speed disregard the magnitude of spring tension. Thus, the music box produces music with regular rhythm.

I claim:

1. A music box, said music box consisting of:

a base;

a spring box, said spring box includes a spring leaf for winding said spring box, a driving gear, and a hole on one side of said spring box;

a sound device, said sound device comprises a metal comb and a cylinder wherein one end of said cylinder is positioned in the hole in said spring box and the opposite end of said cylinder is situated in a support device on said base;

a speed regulator, said speed regulator includes a constant speed device wherein said constant speed device further includes at least two wings perpendicular to a central screw shaft of said regulator, such that when said constant speed device rotates centrifugal force causes said wings to deviate in a radial plane from the central axis of said screw shaft; and a gear transmission system which transmits recoil of said spring leaf to said cylinder and said speed regulator through said driving gear.

2. The music box of claim 1, wherein said wings deviate until touching the sides of a constant speed disc thereby generating friction.

3. The music box of claim 1, wherein said constant speed regulator and said gear system are mounted on said base with a support device.

4. The music box of claim 2, wherein said constant speed device consists of soft silicon.

5. The music box of claim 3, wherein said support consists of engineering plastic.

6. The music box of claim 1, wherein the gears in said gear transmission consists of engineering plastic.

7. The music box of claim 1, wherein the bottom of said base includes a resonance slot to increase the resonance of them music box.

* * * * *